US005513812A

United States Patent [19]

Brundiek

[11] Patent Number: 5,513,812

[45] Date of Patent: May 7, 1996

[54] GRINDING ROLLER

[75] Inventor: Horst Brundiek, Kaarst, Germany

[73] Assignee: Loesche GmbH, Düsseldorf, Germany

[21] Appl. No.: 242,392

[22] Filed: May 13, 1994

[30] Foreign Application Priority Data

Jan. 4, 1994 [DE] Germany ..... 44 00 090.1

[51] Int. Cl.[6] ..... B02C 23/00; B02C 15/00

[52] U.S. Cl. ..... 241/294; 241/117

[58] Field of Search ..... 241/32, 117–121, 241/293, 294; 492/30, 34, 36, 38, 47

[56] References Cited

U.S. PATENT DOCUMENTS 3,721,391 3/1973 Lepola ..... 241/293
3,969,062 7/1976 Komarek ..... 492/38 X
4,168,807 9/1979 Dibowski et al. ..... 241/117 X
5,000,392 3/1991 Peterwerth ..... 241/294

FOREIGN PATENT DOCUMENTS 240338 10/1986 Germany ..... 241/117
1666178 7/1991 U.S.S.R. ..... 241/117

*Primary Examiner*—Timothy V. Eley
*Attorney, Agent, or Firm*—Keck, Mahin & Cate

[57] ABSTRACT

A grinding roller for roller or rolling mills, and its method for manufacture. For inexpensive manufacture and for increasing the service life, accompanied by limited repair expenditure, a roller jacket is manufactured in one piece for mounting on a radially inner roller body. The roller jacket has rated breaking points, along which the roller jacket breaks with radially directed breaking faces in the event of a corresponding stressing. By means of a holding device both the roller jacket manufactured in one piece and the optionally formed roller jacket breaking segments are fixed in an operationally safe manner.

13 Claims, 2 Drawing Sheets

GRINDING ROLLER

FIELD OF THE INVENTION

The invention relates to a grinding roller for roller mills, rolling mills or planishing mills with an inner body and a radially outer roller body, which is made from a harder and more wear resistant material than the radially inner body and has a circumferential or outer peripheral surface with a grinding surface and to a method for manufacturing same.

BACKGROUND OF THE INVENTION

Known grinding rollers for roller or rolling mills generally have a radially inner body and a radially outer roller body. The concept of the radially inner body also covers in this connection a base jacket, which can be fixed to the said body.

On the radially outer roller body is formed a rolling surface, which forms a grinding surface cooperating with a rotary grinding disk or a further grinding roller.

The radially outer roller body must have an extremely high wear resistance. This is brought about by using extremely hard, but at the same time extremely brittle fracture-sensitive materials, which are cast. In many cases such materials additionally undergo a special heat treatment.

However, it has been found that roller bodies made from such materials are highly subject to breakage. The essential reasons for this are internal casting stresses as a result of nonuniform cooling from the outside to the inside, structural stresses due to uncontrolled heat treatments, keying or shrinkage stresses due to mechanical joining by means of conical force fits and the bending loads occurring during joining by means of cylindrical seats with the necessary assembly clearance. Other influencing factors are the rapidly fluctuating temperatures during the grinding process and working stresses, particularly in the case of grinding material requiring high, specific grinding pressures, such as e.g. cement, slag and cement precrushing. As a rule several of the aforementioned factors act in conjunction.

For avoiding breaks and the resulting secondary damage, such as e.g. damage caused by dropping fragments, it is known to use segmented, radially outer roller bodies. However, the disadvantage is then encountered of the high cost manufacture of such segmented roller bodies. As each individual segment has to be individually worked both with respect to its bearing surface and with respect to its two contact faces with the neighbouring segments in a highly precise manner, the necessary time expenditure has a disadvantageous effect on the manufacturing costs.

SUMMARY OF THE INVENTION

According to the invention the aim is to provide a grinding roller and a method for the manufacture thereof, so as to give extremely high service life periods and a low repair risk, enabling manufacture in a particularly simple and therefore cost-effective manner.

According to the invention the advantages existing during the manufacture of a one-piece roller jacket, which as a radially outer roller body is located and fixed on a radially inner body or on a base jacket of said body are combined with the operationally occurring advantages of a roller jacket produced in segmented manner. Whilst avoiding the manufacturing-based costs of a segmented roller jacket, a one-piece roller jacket only segmentable in the grinding process is produced.

According to the invention a roller jacket produced in one piece, e.g. a chilled cast metal ring, can be fixed with the aid of a holding device to a radially inner body. In order to arrive at a segmented, relatively break-proof roller jacket following the manufacture of the one-piece roller jacket and its fixing to the body, rated breaking points are worked in the one-piece manufactured roller jacket and these are in particular ground at clearly defined points already predetermined during the design of a grinding roller. At these rated breaking points, which are preferably in the form of rated breaking notches and made at right angles to the rolling direction of a grinding roller or axially parallel to a grinding roller axis, the one-piece roller jacket will radially break at one or more points and form accurate fitting roller jacket breaking segments, when the grinding roller or the roller jacket is exposed to an internal or external stress exceeding the breaking strength of the material used. According to the invention the material used for the segmentable roller jacket is in particular a brittle material, such as Ni-hard, ceramic or chromium chilled cast metal or similar hard materials without a measurable elongation at break. The roller jacket produced in one piece is also fixed by a holding device to the radially inner body in such a way that the optionally formed roller jacket breaking segments are also reliably fixed and a troublefree operating sequence is ensured.

If the cast material has an extremely high wear resistance and no residual elasticity, then the roller jacket will break precisely and in accurate fitting manner at one or more rated breaking points and become a through-broken chilled cast metal ring or a segmented roller jacket. As soon as roller jacket breaking segments are formed, the residual stresses are almost completely eliminated from the structure. As a result of the clamping holding means a dropping down of the breaking segments and damage caused by the same such as operation shutdown, repairs, etc. are avoided.

Another advantage is that it is possible to use much harder and more wear resistant cast materials and the risk that as a result of uncontrolled breakage of a one-piece roller jacket there will be total damage thereto and also damage on further grinding rollers due to dropping fragments is substantially eliminated.

The inexpensive manufacture of the grinding roller or roller jacket according to the invention is also advantageous. It is initially cast as a one-piece chilled cast metal ring and has an inner, preferably circular cylindrical circumferential surface and an outer circumferential surface with a rolling or grinding surface. The one-piece chilled cast metal ring can be turned without interrupting the structural surface. As the cutting face is constructed in a through manner, hard metal or ceramic cutting plates can be used, so that there is no need for individual segment working for the segmented roller jackets. This leads to an extremely simple and inexpensive manufacture of the roller jacket and the grinding roller.

The rated breaking points are preferably constituted by inner notches ground on the inner circumferential surface and which in the case of a corresponding stressing break radially outwards to the grinding or rolling surface and form roller jacket breaking segments with complimentary breaking surfaces. As the roller jacket breaking segments are held in operationally safe manner by a holding device, particularly by a clamping device, then a breaking segmentation attainable with particularly simple means the grinding process can be continued without disadvantageous down times and maintenance work.

According to an appropriate construction a holding device comprises a clamping ring detachably located on an end face of the grinding roller and which with the aid of a screw connection with a guide ring located on the opposite end face on the radially inner body, ensures a clamping holding both of the one-piece roller jacket and also the roller jacket breaking segments.

Appropriately in the case of a grinding roller for rolling mills, the clamping ring is constructed in several parts and located on the inner end face directed towards the mill axis, in order to permit a simple and easily accessible fixing of the roller jacket to a roll body pivoted out of the mill casing.

The clamping ring comprises individual clamping pieces or shims, which are in each case associated with a possible roller jacket breaking segment, so that a detachment and dropping of a segment are prevented. All the clamping pieces have shapes, which engage in complementary recesses of the segmentable roller jacket.

The shaped, one-piece guide ring is provided with a rotation prevention means, through which there is a circumferential fixing and it is possible to prevent a concomitant rotation of the roller jacket breaking segments independently of the radially inner body.

A particularly effective and simple rotation prevention means is obtained with cams, which project radially and axially from the guide ring and engage in cam receptacles of the segmentable roller jacket.

An advantageous, elastic clamping holding, which compensates the stresses of the rolling process, can be achieved with the aid of a resiliently mounted T-head bolt, which in each case connects in the vicinity of a possible roller jacket breaking segment a clamping piece of the clamping ring with the guide ring and is guided by the radially inner body. Appropriately the T-head bolt is secured in the vicinity of the clamping ring with a nut and an underlaid cup spring.

The rated breaking points formed on the inner circumferential surface as inner notches and optionally on the outer circumferential surface as outer notches, appropriately extend over the entire axial width of the circumferential surface and up to the adjacent end faces of the roller jacket. Spaced from the preferably 10 to 20 mm deep and 5 mm wide inner notches are provided recesses of the fixing areas of the roller jacket, so as to ensure a reliable fixing and holding of the roller jacket breaking segments.

If the outer circumferential surface of a roller jacket is provided with rated breaking points, stresses and a corresponding loading lead to radially inwardly directed breaking surfaces and to the formation of roller jacket breaking segments.

BRIEF DESCRIPTION OF THE DRAWINGS

The invention is described in greater detail hereinafter relative to the attached drawings, wherein show.

DESCRIPTION OF THE PREFERRED EMBODIMENT

Figure 1:
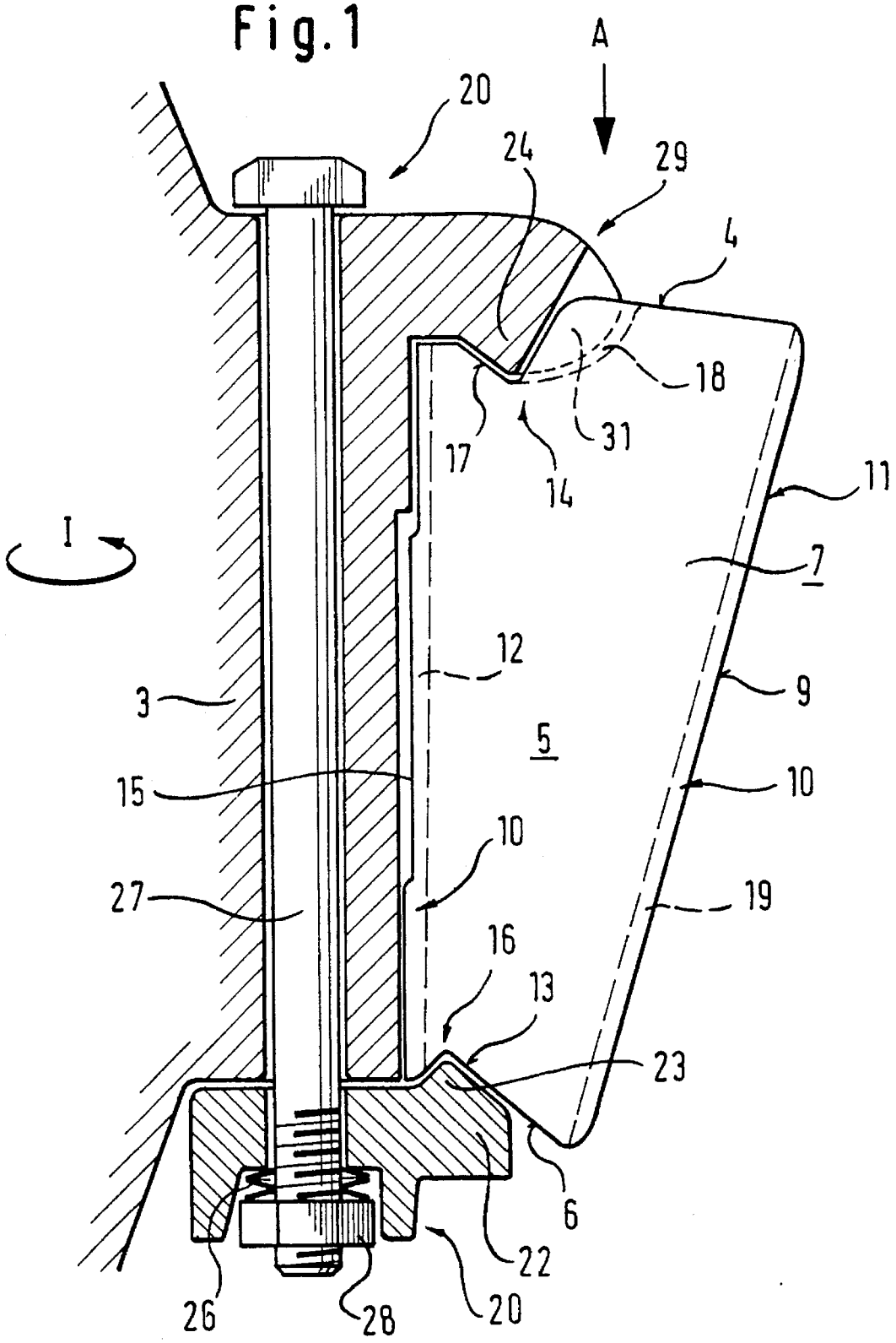
FIG. 1 A detail of an axial section through a grinding roller according to the invention in the vicinity of the segmentable roller jacket.

FIG. 1 shows a grinding roller for a rolling mill in the vicinity of a radially outer roller body 5, which is fixed to a radially inner body 3 of the grinding roller.

The radially outer roller 5 is in the form of a roller jacket 7 manufactured in one piece and which breaks into breaking segments under given operating conditions and which engages and is fixed in operationally safe manner to the body 3 by means of a circular cylindrical, inner circumferential surface 15. In the case of joining by means of a cylindrical seat an assembly clearance is necessary. The segmentable roller jacket 7, which is cast as a chilled cast metal ring and is then turned in a particularly simple and inexpensive method, has an outer, surface-plane circumferential surface 11 with a rolling or grinding surface 9, which in the fitted state is almost parallel to a not shown grinding disk.

In the embodiment according to FIG. 1 the rated breaking points 10 on the inner circumferential surface 15 are in the form of inner notches 12 and on the outer circumferential surface 11 are outer notches 19 approximately at right angles to the rolling direction in accordance with the arrow I. Preferably use is made of a roller jacket with inner notches 12, which with predetermined breakage or fracture edges running radially to the grinding surface 9 can lead to roller jacket breaking segments, so that the stresses causing the fracture are no longer present.

A holding device 20, which comprises a clamping ring 22 with a T-head bolt 27, holds both the one-piece roller jacket 7 and also the optionally occurring roller jacket breaking segments and clamps them elastically against a guide ring 24, which is constructed radially on the facing end face of the radially inner body 3. The clamping ring 22 made from individual clamping pieces has approximately V-shaped positive shapes 23, which engage in complimentary, negative recesses 13 of a fixing area 16 of the roller jacket 7. Oppositely constructed recesses 17 in a frontal fixing area 14 of the segmental roller jacket 7 serve to receive the guide ring 24. The recesses 13, 17 in the end faces 6, 4 of the roller jacket 7 are in each case constructed in a clearly defined, radial spacing from the rated breaking points 10 ground in the form of inner notches 12.

Figure 2:
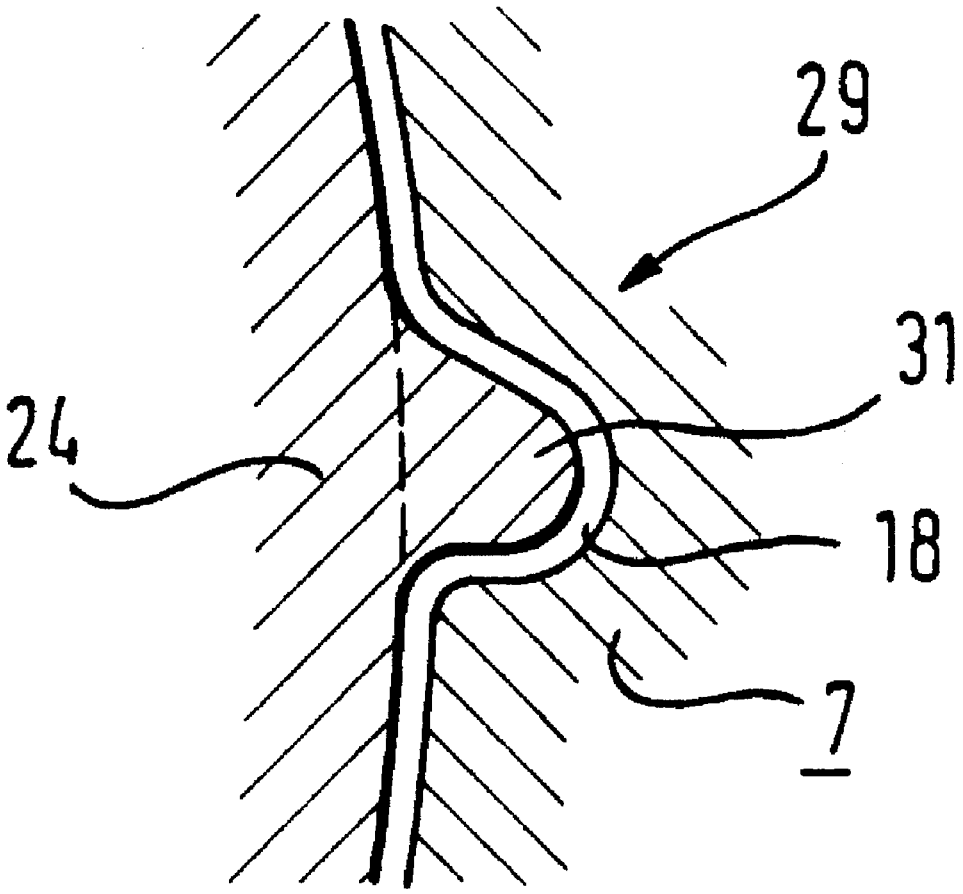
FIG. 2 A view in accordance with arrow A in FIG. 1.

Together with a cam receptacle 18, a cam 31 serves as a rotation prevention means 29 or for fixing the roller jacket breaking segments in the circumferential direction, such as can be gathered from the plan view according to arrow A in FIG. 2.

Advantageously the resilient or elastic clamping holding means of the segmentable roller jacket 7 or roller jacket breaking segments, attainable by a cup spring 26 and a nut 28 in the clamping ring 22, i.e. on the clamping ring-side end of a T-head bolt 27, said bolt 27 being guided by the body 3 and engaging with a bolt head close to the guide ring 24 on the opposite end face of the body 3.

I claim:

1. In a grinding roller for roller mills, rolling mills or planishing mills having a radially inner body and a radially outer roller body made from a much harder and more wear-resistant material than the radially inner body and having an outer circumferential surface with a grinding surface, the improvement comprising the radially outer roller body being a roller jacket formed in one piece, a holding device for fixing the roller jacket to the radially inner body, said roller jacket being provided with rated breaking points for a possible breaking segmentation and wherein in the case of breaking segmentation of the roller jacket the breaking segments resulting from the rated breaking points are held by the holding device.

2. In a grinding roller according to claim 1, wherein the rated breaking points are constructed at right angles to a rolling direction of the grinding roller and run between end faces of the segmentable roller jacket and wherein fixing areas are provided on an end of roller jacket faces which are connected to the holding device.

3. In a grinding roller according to claim 1, wherein the segmentable roller jacket formed in one piece is constructed with an inner circumferential surface which engages with a circular cylindrical face formed as the inner circumferential surface on the radially inner body and wherein the rated breaking points are constructed in at least one of the inner circumferential surface and the outer circumferential surface.

4. In a grinding roller according to claim 1, wherein a chilled cast metal ring is provided as the roller jacket, wherein said rated breaking points comprise inner notches ground on an inner circumferential surface and which in the event of stresses break accompanied by formation of roller jacket breaking segments with radial and complementary breaking faces and wherein the roller jacket breaking segments are held at fixing areas thereon by a clamping ring as a holding device cooperating with a guide ring of the radially inner body.

5. In a grinding roller according to claim 4, wherein the clamping ring is constructed in multiparts, each having a shape to engage in a complementary recess formed in the segmentable roller jacket and wherein holding and clamping of the resulting roller jacket breaking segments is brought about by the clamping ring connected to the facing guide ring.

6. In a grinding roller according to claim 5, wherein the clamping ring comprises individual clamping portions and wherein each clamping portion is associated with a grinding roller breaking segment predetermined by the rated breaking points.

7. In a grinding roller according to claim 5, wherein each clamping portion of the clamping ring is connected by a T-head bolt to the guide ring, the T-head bolt being guided parallel to a grinding roller axis through the radially inner body and being elastically mounted on at least an end of said bolt adjacent the clamping ring.

8. In a grinding roller according to claim 5, wherein the multipart clamping ring and the guide ring have an approximately V-shaped cross-section and the complementary constructed recesses of the fixing areas of the segmentable roller jacket are at a clearly defined spacing from the inner circumferential surface and the inner notches forming the as rated breaking points.

9. In a grinding roller according to claim 8, wherein the rated breaking points are formed by said inner notches and by outer notches formed on the grinding surface, said notches having a width of approximately 5 mm and a depth of from about 10 to about 20 mm.

10. In a grinding roller according to claim 9, wherein the rated breaking points have a constant depth and width over their entire axial length.

11. In a grinding roller according to claim 4 wherein the holding device has a rotation prevention means so as to prevent a concomitant rotation of the segmentable roller jacket and roller jacket breaking segments.

12. In a grinding roller according to claim 11, wherein the rotation prevention means comprises by cams, which project from the guide ring and engage in cam receptacles, which are formed in the fixing area of the segmentable roller jacket.

13. In a grinding roller according to claim 1, wherein the segmentable roller jacket is made from a brittle material selected from the group consisting of a ceramic material, chromium chilled cast metal, Ni-hard material and a hard material without a measurable elongation at break.

* * * * *